US010861630B2

(12) United States Patent
Ryu et al.

(10) Patent No.: US 10,861,630 B2
(45) Date of Patent: Dec. 8, 2020

(54) INDUCTOR

(71) Applicant: SAMSUNG ELECTRO-MECHANICS CO., LTD., Suwon-si (KR)

(72) Inventors: Han Wool Ryu, Suwon-si (KR); Jung Hyuk Jung, Suwon-si (KR); Hyo Chan Oh, Suwon-si (KR); Yoon Hee Kim, Suwon-si (KR); Woon Chul Choi, Suwon-si (KR); Jin Ho Ku, Suwon-si (KR); Il Jin Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 305 days.

(21) Appl. No.: 15/581,123

(22) Filed: Apr. 28, 2017

(65) Prior Publication Data

US 2018/0033533 A1 Feb. 1, 2018

(30) Foreign Application Priority Data

Jul. 27, 2016 (KR) ..... 10-2016-0095675
Nov. 21, 2016 (KR) ..... 10-2016-0154827

(51) Int. Cl.
*H01F 27/29* (2006.01)
*H01F 17/00* (2006.01)
*H01F 3/10* (2006.01)

(52) U.S. Cl.
CPC ..... *H01F 17/0013* (2013.01); *H01F 3/10* (2013.01); *H01F 2003/106* (2013.01); *H01F 2017/0066* (2013.01)

(58) Field of Classification Search
CPC ..... H01F 17/0013; H01F 27/255; H01F 3/08; H01F 1/14791; H01F 5/003; H01F 41/02; H01F 41/0246; H01F 1/22; H01F 3/10
(Continued)

(56) References Cited

U.S. PATENT DOCUMENTS 4,104,389 A * 8/1978 Schwender ..... C07D 491/14 514/267
5,051,970 A * 9/1991 Ishii ..... G11B 11/10582 369/13.49
(Continued)

FOREIGN PATENT DOCUMENTS

CN 1137496 A 12/1996
CN 1487536 A 4/2004
(Continued)

OTHER PUBLICATIONS

Office Action issued in Korean Application No. 10-2016-0154827 dated Apr. 18, 2019, with English translation.
(Continued)

*Primary Examiner* — Alexander Talpalatski
*Assistant Examiner* — Joselito Baisa
(74) *Attorney, Agent, or Firm* — Morgan, Lewis & Bockius LLP

(57) ABSTRACT

An inductor includes a body having a first magnetic portion above and below a coil, and a second magnetic portion above and below the first magnetic portion. The magnetic flux density of the magnetic substance in the first magnetic portion is higher than that of the magnetic substance in the second magnetic portion.

19 Claims, 2 Drawing Sheets

(58) Field of Classification Search
USPC ..... 336/192, 200
See application file for complete search history.

(56) References Cited

U.S. PATENT DOCUMENTS

| | | | | |
|---|---|---|---|---|
| 6,140,902 | A | 10/2000 | Yamasawa et al. | |
| 6,351,204 | B1 * | 2/2002 | Yamasawa | H01F 10/187 336/200 |
| 6,392,525 | B1 * | 5/2002 | Kato | H01F 3/08 336/200 |
| 6,459,351 | B1 * | 10/2002 | Maki | H01F 27/2804 336/200 |
| 8,466,764 | B2 * | 6/2013 | Bogert | H01F 5/003 336/83 |
| 8,610,525 | B2 * | 12/2013 | Matsuura | H01F 17/0033 336/200 |
| 8,975,997 | B2 * | 3/2015 | Tonoyama | H01F 27/255 336/200 |
| 9,269,486 | B2 * | 2/2016 | Park | H01F 27/255 |
| 9,490,060 | B2 * | 11/2016 | Yamamoto | H01F 1/14716 |
| 9,536,660 | B2 * | 1/2017 | Park | H01F 41/046 |
| 9,892,843 | B2 * | 2/2018 | Arai | H01F 1/28 |
| 9,997,288 | B2 * | 6/2018 | Yamaguchi | H01F 17/0006 |
| 2009/0068400 | A1 * | 3/2009 | Lotfi | H01F 17/0006 428/138 |
| 2012/0105188 | A1 * | 5/2012 | Lim | H01F 17/0033 336/200 |
| 2013/0033347 | A1 * | 2/2013 | Matsuura | H01F 17/0013 336/83 |
| 2013/0147591 | A1 * | 6/2013 | Kim | H01F 17/04 336/200 |
| 2013/0154784 | A1 | 6/2013 | Hachiya et al. | |
| 2013/0249662 | A1 | 9/2013 | Tonoyama et al. | |
| 2013/0322135 | A1 | 12/2013 | Kusawake et al. | |
| 2014/0184374 | A1 | 7/2014 | Park et al. | |
| 2015/0128710 | A1 * | 5/2015 | Vinogradov | G01N 29/223 73/627 |
| 2015/0371752 | A1 * | 12/2015 | Park | H01F 27/255 336/200 |
| 2016/0293315 | A1 * | 10/2016 | Kim | H01F 3/10 |
| 2017/0148560 | A1 * | 5/2017 | Yoon | H01F 27/2804 |

FOREIGN PATENT DOCUMENTS

| | | | |
|---|---|---|---|
| CN | 103415902 | A | 11/2013 |
| CN | 105225802 | A | 1/2016 |
| CN | 103165258 | B | 8/2016 |
| JP | 2013-201374 | A | 10/2013 |
| JP | 2014-41962 | A | 3/2014 |
| KR | 1998-018443 | A | 6/1998 |
| KR | 10-2014-0085997 | | 7/2014 |
| KR | 10-1580399 | B1 | 12/2015 |

OTHER PUBLICATIONS

Office Action issued in corresponding Chinese Patent Application No. 201710491683.9 dated Nov. 4, 2019, with English translation.
Office Action issued in Korean Patent Application No. 10-2016-0154827 dated Aug. 30, 2019, with English translation.
Second Office Action issued in corresponding Chinese Patent Application No. 201710491683.9 dated Mar. 27, 2020, with English translation.

* cited by examiner

INDUCTOR

CROSS-REFERENCE TO RELATED APPLICATION

This application claims the benefit of priority to Korean Patent Application Nos. 10-2016-0095675, filed on Jul. 27, 2016 and 10-2016-0154827, filed on Nov. 21, 2016 with the Korean Intellectual Property Office, the entirety of which is incorporated herein by reference.

BACKGROUND

1. Field

The present disclosure relates to an inductor.

2. Description of Related Art

Inductors are important passive devices in electronic circuits, along with resistors and capacitors, and may be used in components, or the like, that remove noise or comprise resonant circuits.

Inductors may be mounted in application processors (APs), communication processors (CPs), smartphone or wearable device chargers, display device power management integrated circuits (PMIC), or the like, to supply power thereto.

Conventional inductors may have magnetic bodies formed of a single material, and may allow magnetic flux to flow around coils.

To perform smartphone and multi-input multi-output (MIMO) communications that have recently been an issue, a direct current (DC) bias of at least 2 A or higher may be required. To this end, a high level of inductance is required, even at a high level of current. However, it may be difficult to meet such conditions due to conventional inductors having a relatively low level of DC bias.

Accordingly, as products use higher levels of current, the demand increases for inductors that have excellent bias characteristics while maintaining a certain level of inductance.

SUMMARY

An aspect of the present disclosure may provide an inductor which may provide high bias characteristics while maintaining a high level of inductance even at a high level of current.

According to an aspect of the present disclosure, an inductor may include: a body having a first magnetic portion above and below a coil, and a second magnetic portion above and below the first magnetic portion, in which a magnetic flux density of a first magnetic substance included in the first magnetic portion may be higher than a magnetic flux density of a second magnetic substance included in the second magnetic portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
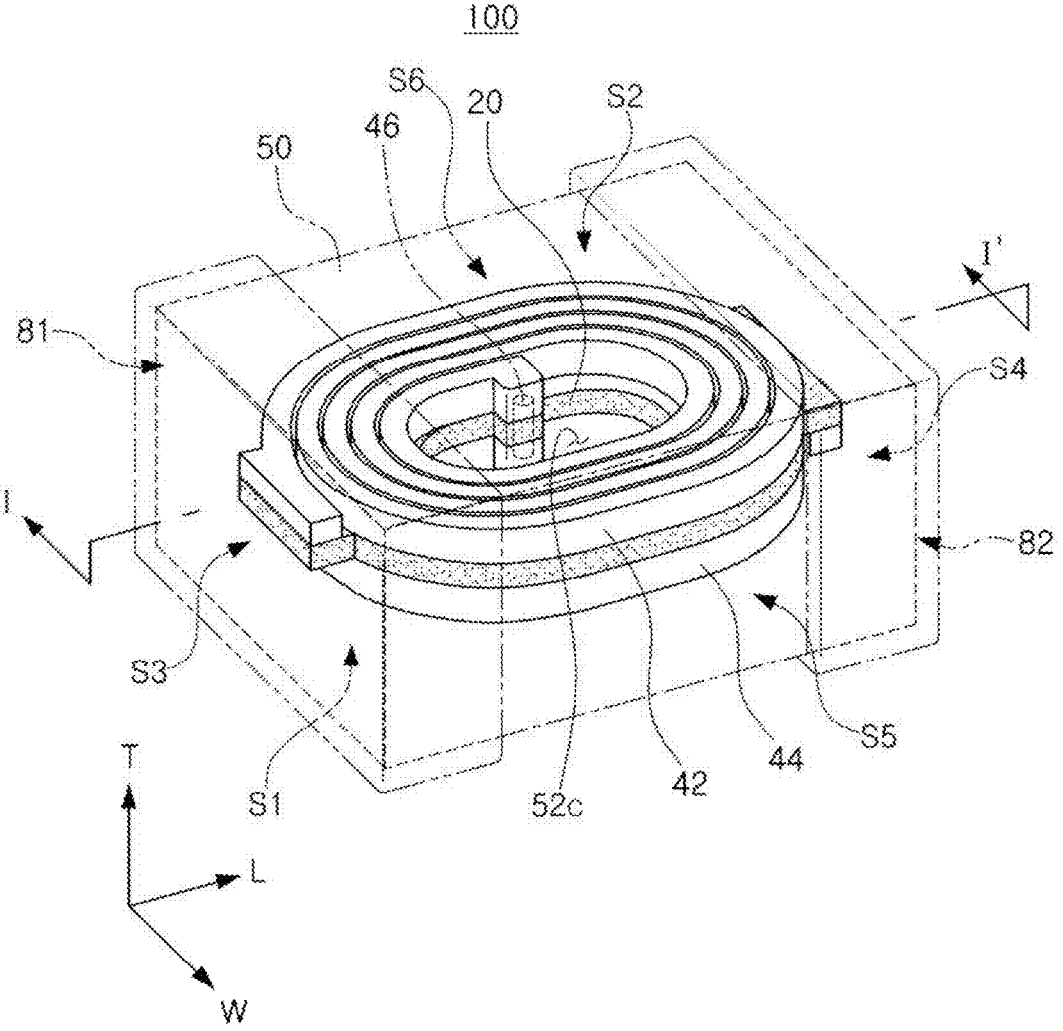
FIG. 1 is a schematic cutaway perspective view of an inductor according to an embodiment.

Hereinafter, embodiments of the present disclosure will be described with reference to the drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there are no other substantial elements or layers intervening therebetween. Like numerals refer to like elements throughout.

It will be apparent that although the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s), as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape resulting from manufacturing. The following embodiments may also be constituted alone or as a combination thereof.

The contents of the present disclosure may have a variety of configurations and only a required configuration is proposed herein, but the present disclosure is not limited thereto.

Figure 2:
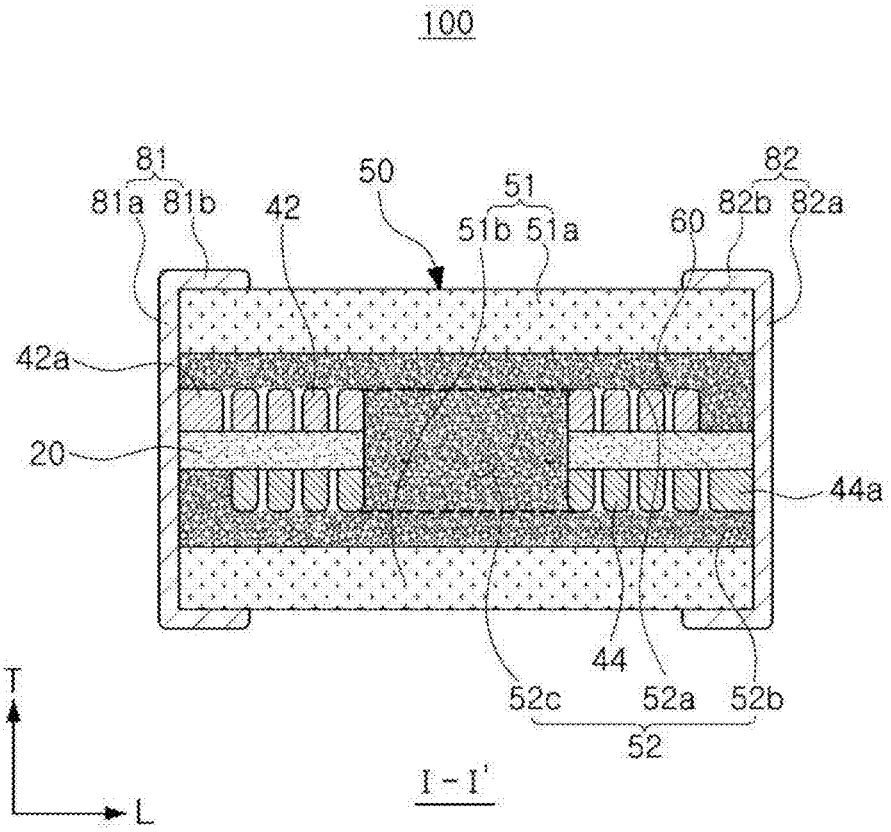
FIG. 2 is a cross-sectional view taken along line I-I' of FIG. 1.
Figure 3:
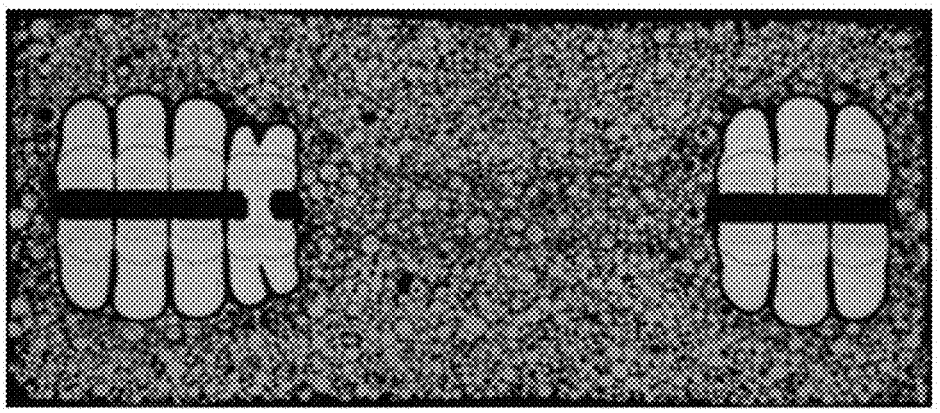
FIG. 3 is a scanning electron microscope (SEM) image of an internal structure of an inductor according to an embodiment.

FIG. 1 is a cutaway perspective view schematically illustrating an inductor according to an exemplary embodiment. FIG. 2 is a cross-sectional view taken along line I-I' of FIG. 1. FIG. 3 is a scanning electron microscope (SEM) image of an internal structure of an inductor according to an exemplary embodiment.

In the drawings, the L direction may be defined as a length direction of a body 50, the W direction as a width direction, and the T direction as a thickness direction.

Surfaces opposing each other in the T direction of the body 50 may be defined as a first surface S1 and a second surface S2. Surfaces opposing each other in the L direction of the body 50 may be defined as a third surface S3 and a fourth surface S4. Surfaces opposing each other in the W direction of the body 50 may be defined as a fifth surface S5 and a sixth surface S6.

Referring to FIGS. 1 through 3, an inductor 100 according to an embodiment may include a support 20 having a coil disposed thereon, and a body 50.

The body 50 may form an exterior of the inductor 100, and may have a substantially rectangular parallelepiped shape.

The body 50 may include a first magnetic portion 52 and a second magnetic portion 51.

The first magnetic portion 52 may be disposed in a center of the body 50 in the T direction, and may include a first internal layer 52*a* and a second internal layer 52*b* disposed on upper and lower surfaces of a core 52*c* and the support 20, respectively.

The core 52*c* may refer to a portion of the first magnetic portion 52 that is formed by filling a core hole with a first magnetic substance. The core hole may be formed through the support 20 in the center of the body 50.

When the core 52*c*, filled with the first magnetic substance, is formed in the body 50, inductance of the inductor 100 may be further increased, compared to where the body 50 does not include a core.

The second magnetic portion 51 may include a first external layer 51*a* and a second external layer 51*b* disposed on upper and lower surfaces of the first magnetic portion 52, respectively.

In the body 50, a magnetic flux density of the first magnetic substance included in the first magnetic portion 52 may be higher than that of a second magnetic substance included in the second magnetic portion 51.

The support 20 may be within the first magnetic portion 52.

The support 20 may include a substrate formed of an insulating material, such as photosensitive polymer for example, or a conductive material, such as ferrite for example, but the present disclosure is not limited thereto.

The coil may include a first coil 42 and a second coil 44 disposed on the surfaces of the support 20 in the T direction, respectively.

The first and second coils 42 and 44 may have spiral structures, respectively, or may have different shapes, as necessary.

For example, each of the first and second coils 42 and 44 may have a polygonal shape, such as a quadrangular, pentagonal, or hexagonal shape, a circular shape, an elliptical shape, or the like, or as necessary, may have an irregular shape.

The first and second coils 42 and 24 may include at least one of gold, silver, platinum, copper, nickel, palladium, and alloys thereof.

However, the present disclosure is not limited thereto, and the first and second coils 42 and 44 may be sufficient as long as they include a material having conductivity.

The first coil 42 may have a first lead portion 42*a* formed at an end thereof to be exposed at the third surface S3 of the body 50.

The second coil 44 may have a second lead portion 44*a* formed at an end thereof to be exposed at the fourth surface S4 of the body 50.

Opposing ends of the first and second coils 42 and 44 may oppose each other in the T direction, and may be electrically connected to each other by a via 46.

The via 46 may be formed by forming a via hole in and filling the via hole with a conductive paste.

The conductive paste may include at least one of gold, silver, platinum, copper, nickel, palladium, and alloys thereof, but the present disclosure is not limited thereto. The conductive paste may be sufficient as long as it includes a material having conductivity.

To insulate the first and second coils 42 and 44 from the body 50, the first and second coils 42 and 44 may have an insulating layer 60 formed on the circumference of the first and second coils 42 and 44 to cover surfaces of the first and second coils 42 and 44.

The insulating layer 60 may include a material having insulating properties, for example, a polymer or the like, but the present disclosure is not limited thereto.

The first and second magnetic portions 52 and 51 may include the first and second magnetic substances, respectively, each including a paste that includes a compound of a polymer and a metal powder, such as ferrite.

The first and second magnetic substances may include the metal powder dispersed on the polymer to thus provide insulating properties to surfaces of the first and second magnetic substances.

The metal powder may include at least one of iron (Fe), a nickel-iron (Ni—Fe) alloy, an iron-silicon-aluminum (Fe—Si—Al) alloy (referred to as "sendust"), and an iron-silicon-chromium (Fe—Si—Cr) alloy.

The first magnetic portion 52 may include the first internal layer 52*a* covering an upper portion of the first coil 42, the second internal layer 52*b* covering a lower portion of the second coil 44, and the core 52*c* formed in a center of the body 50.

The first magnetic portion 52 may include the first magnetic substance having a magnetic flux density higher than that of the second magnetic portion 51.

Here, a magnetic flux density of the first magnetic substance may be from 1.4 T to 1.7 T.

A magnetic flux density of the first magnetic substance less than 1.4 T reduces bias characteristics of the inductor 100. A magnetic flux density of the first magnetic substance exceeding 1.7 T may cause the first magnetic substance to be crystallized and thus increase its coercive force to be 5.0 Oe.

The iron content of the first magnetic substance may be in inverse proportion to the resin content of the first magnetic substance, and an increased resin content may further interfere with the flow of magnetic flux. Thus, the inductance of the inductor 100 may be relatively further reduced.

When the iron content of the first magnetic substance is high and the resin content is excessively low in the first magnetic substance, processing properties for formation of the body 50 may not be properly provided.

In this embodiment, an iron content of the first magnetic substance may be from 78 at % to 83 at %.

When an iron content of the first magnetic substance is less than 78 at %, high-current properties may not be properly provided. In addition, when an iron content of the first magnetic substance exceeds 83 at %, amorphous atomization properties may not be properly provided, and thus, the first magnetic substance may be crystallized in an amorphous state.

In the first magnetic portion 52, thicknesses of the first internal layer 52*a* covering the upper portion of the first coil 42 and the second internal layer 52*b* covering the lower portion of the second coil 44 may be from 70 μm to 120 μm.

When the thicknesses of the first and second internal layers 52*a* and 52*b* of the first magnetic portion 52 are less than 70 μm, the path of the first magnetic portion 52 may become narrow, and the magnetic flux may be readily saturated, resulting in a reduction in the bias characteristic.

When the thicknesses of the first and second internal layers 52*a* and 52*b* of the first magnetic portion 52 are less than 120 μm, permeability may be reduced, and thus, the inductance of the inductor 100 may be decreased.

The second magnetic portion 51 may include the first and second external layers 51*a* and 51*b* respectively disposed on outer surfaces, for example, upper and lower surfaces, of the first and second internal layers 52*a* and 52*b* of the first magnetic portion 52 in the T direction.

The second magnetic portion 51 may include the second magnetic substance having a magnetic flux density lower than that of the first magnetic portion 52.

The iron content of the second magnetic substance may be 76 at % or less. When the iron content of the second magnetic substance exceeds 76 at %, permeability may be reduced, and thus, the inductance of the inductor 100 may be decreased.

When the second magnetic substance has an iron content of 76 at % or less, compared to the first magnetic substance, the bias characteristic may be degraded, but the permeability may be increased. When the magnetic flux density of the second magnetic substance is less than 1.1 T, the bias characteristic may be degraded. When the magnetic flux density of the second magnetic substance exceeds 1.3 T, the permeability may be reduced, which may decrease the inductance of the inductor 100. Accordingly, the magnetic flux density of the second magnetic substance may be from 1.1 T to 1.3 T.

The total volume of the first magnetic portion 52 may be 33% to 75% of that of the second magnetic portion 51 in consideration of a balance between DC resistance (Rdc) and inductance (Ls) according to a thickness of the coil.

When the total volume of the first magnetic portion 52 is less than 33% of the second magnetic portion 51, the bias characteristic may be degraded. When the total volume of the first magnetic portion 52 exceeds 75% of the second magnetic portion 51, the inductance of the inductor 100 may be decreased.

The inductor 100, according to this embodiment, may further include a first external electrode 81 and a second external electrode 82 disposed on the body 50.

The first external electrode 81 may be disposed on the third surface S3 of the body 50.

The first external electrode 81 may include a first connection portion 81*a* and a first band portion 81*b*.

The first connection portion 81*a* may be formed on the third surface S3 of the body 50, and may be connected to an exposed portion of the first lead portion 42*a* of the first coil 42.

The first band portion 81*b* may extend from the first connection portion 81*a* to portions of the first, second, fifth, and sixth surfaces (S1, S2, S5, and S6) of the body 50 to increase bonding strength of the first external electrode 81.

The second external electrode 82 may be disposed on the fourth surface S4 of the body 50.

The second external electrode 82 may include a second connection portion 82*a* and a second band portion 82*b*.

The second connection portion 82*a* may be formed on the fourth surface S4 of the body 50, and may be connected to an exposed portion of the second lead portion 44*a* of the second coil 44.

The second band portion 82*b* may extend from the second connection portion 82*a* to portions of the first, second, fifth, and sixth surfaces (S1, S2, S5, and S6) of the body 50 to increase bonding strength of the second external electrode 82.

Each of the first and second external electrodes 81 and 82 may include a conductive metal and may include, for example, at least one of gold, silver, platinum, copper, nickel, palladium, and alloys thereof.

The first and second external electrodes 81 and 82 may have a nickel plated layer (not illustrated) or a tin plated layer (not illustrated) formed on surfaces of the first and second external electrodes 81 and 82, as necessary.

When a current is applied to an inductor, magnetic flux may occur around a coil. The density of the magnetic flux may be significantly increased around the coil, and may decrease away from the coil.

To improve bias characteristics of such an inductor, it may be necessary to allow magnetic flux to be readily saturated by increasing a magnetic flux density (a capacity of the inductor capable of passing magnetic flux per unit volume) of a magnetic substance that surrounds the periphery of the coil, such that a strong magnetic flux may smoothly flow around the coil.

In the inductor 100 according to this embodiment, the first magnetic portion 52 may include the first magnetic substance, having an iron content of 78 at % or more, a low permeability, and a high magnetic flux density. The second magnetic portion 51 may include the second magnetic substance, having an iron content of 76 at % or less, high permeability, relatively low magnetic flux density, and relatively reduced bias characteristics.

In the inductor 100, the periphery of the coil where the magnetic flux density is concentrated may include the first magnetic substance that includes a composition with a high magnetic flux density. The second magnetic portion 51 corresponding to an outer cover region of the body 50 may include the second magnetic substance with a magnetic flux density lower than that of the first magnetic substance, but having relatively high permeability.

The saturation of the magnetic flux intensively flowing around the coil may thus be reduced to increase the level of a saturation current (a bias current) of the magnetic flux, thereby improving high-current properties. As a result, without a reduction in the inductance, the inductor 100 may improve the bias characteristic by about 15% to 20%, compared to a conventional inductor including only a magnetic substance that has low magnetic flux density.

As set forth above, according to an embodiment, bias characteristics of an inductor while maintaining a high level of inductance even at a high level of current may be improved.

While exemplary embodiments have been shown and described above, it will be apparent to those skilled in the art that modifications and variations could be made without departing from the scope of the present invention, as defined by the appended claims.

What is claimed is:

1. An inductor comprising:

a body having a first magnetic portion above and below a coil, and a second magnetic portion disposed above and below the first magnetic portion, wherein a magnetic flux density of a first magnetic substance included in the first magnetic portion is higher than a magnetic flux density of a second magnetic substance included in the second magnetic portion, and wherein an at % iron content of the first magnetic substance is from 78 at % to 83 at % and an at % iron content of the second magnetic substance is different from the at % iron content of the first magnetic substance.

2. The inductor of claim 1, wherein the body has a core in a center of the body, and the core includes the first magnetic substance.

3. The inductor of claim 1, wherein the first magnetic substance includes a compound of a first polymer and the iron content from 78 at % to 83 at %, and the second magnetic substance includes a compound of a second polymer and an iron content of 76 at % or less.

4. The inductor of claim 1, wherein the magnetic flux density of the first magnetic substance is from 1.4 T to 1.7 T, and the magnetic flux density of the second magnetic substance is from 1.1 T to 1.3 T.

5. The inductor of claim 1, wherein a total volume of the first magnetic portion is from 33% to 75% of a total volume of the second magnetic portion.

6. The inductor of claim 1, wherein the first magnetic portion includes a first internal layer covering an upper portion of the coil and a second internal layer covering a lower portion of the coil, and thicknesses of the first internal layer and the second internal layer are each from 70 μm to 120 μm.

7. The inductor of claim 1, wherein the coil is on a support that includes a substrate formed of an insulating or magnetic material.

8. The inductor of claim 1, further comprising: an insulating layer covering the coil.

9. The inductor of claim 1, wherein the coil includes a first coil and a second coil respectively on opposing surfaces of a support, the first coil and the second coil respectively have a first lead portion and a second lead portion exposed to outside the body, and the body includes a first external electrode and a second external electrode on the body and electrically connected to the first lead portion and the second lead portion, respectively.

10. The inductor of claim 1, wherein the first magnetic substance includes a metal powder including an iron-silicon-chromium (Fe—Si—Cr) alloy dispersed in a first polymer.

11. The inductor of claim 1, wherein the first magnetic substance extends only in a first space, between the coil and an external electrode disposed on a side surface of the body, from among the first space and second spaces between adjacent windings of the coil.

12. An inductor comprising:

a support with a core hole in a center portion;

a first coil on an upper surface of the support and around the core hole;

a second coil on a lower surface of the support, around the core hole, and connected to the first coil by a via through a via hole in the support;

a first magnetic portion, with a first magnetic flux density from 1.4 T to 1.7 T and an iron content from 78 at % to 83 at %, including a first internal layer above the first coil, a second internal layer below the second coil, and a core formed in the core hole of the support; and a second magnetic portion, with a second magnetic flux density from 1.1 T to 1.3 T, including a first external layer above the first internal layer of the first magnetic portion and a second external layer below the second internal layer of the first magnetic portion, wherein the first magnetic portion includes a compound of a first polymer and the iron content from 78 at % to 83 at % and the second magnetic portion includes a compound of a second polymer and an iron content of 76 at % or less.

13. The inductor of claim 12, wherein a total volume of the first magnetic portion is from 33% to 75% of a total volume of the second magnetic portion.

14. The inductor of claim 12, wherein first and second internal layers of the first magnetic portion each have a thickness from 70 μm to 120 μm.

15. The inductor of claim 12, wherein the first magnetic portion includes a metal powder including an iron-silicon-chromium (Fe—Si—Cr) alloy dispersed in a first polymer.

16. An inductor comprising:

a body including one or more coils each winding in a plane defined by a width and a length direction of the body, and perpendicular to a thickness direction of the body;

wherein a first magnetic flux density of a center portion of the body in the thickness direction is higher than a second magnetic flux density of an outer portion of the body above or below the center portion in the thickness direction, and wherein an at % iron content of the center portion is from 78 at % to 83 at %, and an at % iron content of the outer portion is different from the at % iron content of the center portion.

17. The inductor of claim 16, wherein the center portion has a compound of a first polymer and the iron content from 78 at % to 83 at % and the outer portion includes a compound of a second polymer and an iron content of 76 at % or less.

18. The inductor of claim 16, wherein a first portion of the body with the first magnetic flux density is from 33% to 75% of a total volume of a second portion of the body with the second magnetic flux density.

19. The inductor of claim 16, wherein the first magnetic flux density is from 1.4 T to 1.7 T, and the second magnetic flux density is from 1.1 T to 1.3 T.

* * * * *